US005988836A

United States Patent [19]

Swarens

[11] Patent Number: 5,988,836

[45] Date of Patent: Nov. 23, 1999

[54] RECESSED INDIRECT FLUORESCENT LIGHT FIXTURE WITH FLEXIBLE REFLECTOR

[76] Inventor: Ralph W. Swarens, 1830 Olivewood St., La Verne, Calif. 91750

[21] Appl. No.: 08/903,642

[22] Filed: Jul. 31, 1997

Related U.S. Application Data

[60] Provisional application No. 60/023,114, Jul. 31, 1996.

[51] Int. Cl.[6] ..... F21V 7/12

[52] U.S. Cl. ..... 362/364; 362/278; 362/320; 362/303; 362/217

[58] Field of Search ..... 362/298, 303, 362/217, 225, 348, 278, 320, 364

[56] References Cited

U.S. PATENT DOCUMENTS

| | | | |
|---|---|---|---|
| 1,888,103 | 11/1932 | Guth | 362/348 |
| 1,900,551 | 3/1933 | Guth | 362/348 |
| 4,409,646 | 10/1983 | Baliozian | 362/319 |
| 5,142,459 | 8/1992 | Swarens | 362/217 |

*Primary Examiner*—Sandra O'Shea
*Assistant Examiner*—Marshall Moneyman
*Attorney, Agent, or Firm*—J. E. McTaggart

[57] ABSTRACT

An indirect fluorescent lighting fixture with a self-contained curved reflector is enclosed in a square housing that fits into an inverted T-bar grid cell of a suspended ceiling in place of 2'×2' ceiling tile, or it can be permanently mounted in a wall or ceiling. A centrally located fluorescent tube, extending between two opposite sides of the enclosure, is enclosed from view by a U shaped shield. The reflector, disposed above the tube directing light downwardly into a targeted room region, can be made with a single concave curvature for narrower "spotlight" applications or with a dual concave curvature for wider field applications. The reflector is held in place in a self-stressed condition between a pair of end channels such that its shape can be controlled by varying its length. The illumination pattern can be controlled and modified by a combination of shaping the reflector's curvature and selection of its reflective surface properties. An embodiment made with a dual concave curvature reflector surfaced with small ramp ridges provides wide angle coverage free of high angle glare, enabling uniform coverage of large areas with multiple optimally spaced fixtures.

10 Claims, 3 Drawing Sheets

RECESSED INDIRECT FLUORESCENT LIGHT FIXTURE WITH FLEXIBLE REFLECTOR

PRIORITY

Benefit is claimed under 35 U.S.C, § 119(e) of pending provisional application #60/023,114 filed Jul. 31, 1996.

FIELD OF THE INVENTION

The present invention relates to the field of electric lighting products, and more particularly it relates to a recessed indirect fluorescent light fixture of the internal reflection category.

BACKGROUND OF THE INVENTION

Lighting fixtures utilizing fluorescent tubes are well known and find widespread usage in all kinds of residential, industrial, commercial and institutional environments, and can be categorized as direct or indirect. "Direct lighting" fixtures, which heavily predominate, direct light downwardly from above, often passing through some form of diffuser to reduce glare and soften harshness, but otherwise travelling directly from the fluorescent tubes to the targeted area in a single straight line path. "Indirect lighting" fixtures are made and/or arranged to shield room occupants from the direct light of the tube, while illuminating a targeted area with reflected light; thus instead of reaching the targeted area via a single straight line path, the path becomes folded as the light is redirected by one or more reflective surfaces. Indirect lighting fixtures can be further subdivided into two main categories:

(1) external reflection fixtures which rely on white or other light-colored room surfaces, typically white ceilings, as the principal reflecting surface. Usually the main housing is a compact elongated enclosed rectangular box containing associated wiring, connectors, ballasts and/or transformers, etc. The fixture is mounted with the fluorescent tube on top, directing light upwardly to the ceiling region, while some form of baffle shields room occupants from direct view of the tube(s). Such fixtures may utilize the small amount of auxiliary reflection available from the top side of the housing beneath the tube by making it white or otherwise reflective. Additional auxiliary reflection may be picked up by the addition of side wings, which can also serve as shielding baffles;

(2) internal reflection indirect fixtures wherein substantially all reflection occurs within the fixture by means of a built-in shaped reflector, preferably made with a specially curved mirror surface, constructed and arranged to project light in a pattern of required uniformity in a targeted area with the fixture installed at a designated room location. A fixture of this category can be beneficially recessed in a selected wall or ceiling location to accomplish the desired illumination. The internal reflection category is advantageous over the external reflection category in eliminating dependency on the efficiency and color of the ceiling, and in enabling control of the illumination pattern.

When utilized in ceiling arrays, light fixtures are generally arranged in an array that yields a grid pattern of (ideally) square or rectangular illumination zones that overlap in a manner to provide acceptably uniform overall illumination. It is also important to suppress the escape of light from the fixtures at high angles from vertical that tend to cause annoying glare from the fixtures as perceived by room occupants. The compromise dictated by these two conflicting requirements becomes more critical with lower ceiling height, e.g. 8 or 10 ft.

A useful definition for the illumination boundary of a fixture is the half-power point where the intensity, i.e. candlepower, falls off to half as related to regions of maximum intensity, since at a reference horizontal targeted plane, e.g. floor or desktops, ideal overlapping from an adjacent fixture at the boundary would restore the intensity to full value. Thus the pattern of light divergence from the fixture can be defined as two angles from vertical, one, referred to as "0°" or "parallel", being taken at half power in a first vertical plane through the main lamp axis, the other, "90°" or "perpendicular" being taken at half power in a second vertical plane perpendicular to the lamp axis.

To optimally satisfy the two conflicting requirements described above for low ceilings, it has been found that the half power angle should be made at least about 45° to minimize the number of fixtures required but should be held below about 55° to minimize glare.

DISCUSSION OF RELATED KNOWN ART

In the external reflection category of indirect lighting fixtures discussed above, fixtures are generally located beneath a reflective ceiling region facing upwardly, the light being directed upwardly so as to reflect from the ceiling and thusly illuminate the room area: examples of such fixtures are found in U.S. Pat. Nos. 4,651,259, 5,266,724, 5,097,401, 5,051,878, 4,388,675 and 4,975,812. With indirect lighting fixtures of this externally reflected category, it is normally easy to keep the fluorescent tube shielded from the view of room occupants, especially if the fixture is located near the ceiling, above the head level of occupants, with a housing extending beneath and around the sides of the tube(s).

U.S. Pat. Nos. 4,748,543 and 5,142,459 by the present inventor disclose indirect lighting fixtures of the internal reflection category discussed above: these two patents are incorporated herein by reference for purposes of describing the background and general principles of lighting products in this category. These two patents relate to a particular subdivision of the internal reflection category: the offset type, characterized by the tube being located behind a light baffle in an extremely offset location near an edge of the fixture and the reflector being configured in a correspondingly asymmetrical shape, such that the targeted region of uniform illumination is substantially offset from the fixture.

OBJECTS OF THE INVENTION

It is a primary object of the present invention to provide a recessed type fluorescent light fixture having a reflector that is shaped symmetrically relative to the fluorescent tube and that is furthermore shaped in a manner to enhance the uniformity of illumination in a targeted room region that is generally centered about the fixture.

It is a further object of the present invention to shield the fluorescent tube from direct view of persons in the targeted room.

It is a further object that the fixture to be constructed and arranged to be readily installable in ceilings of standard construction, i.e. of gyprock, or suspended subceiling of the type where ceiling panels are supported by a grid pattern of inverted T-bar support strips.

It is a further object, in fixtures for multiple installation in low ceilings, to control the light divergence pattern to yield half power angles between 45 and 55 degrees from vertical in both the 0° and the 90° planes, so as to maximize illumination coverage while minimizing glare.

SUMMARY OF THE INVENTION

The abovementioned objects have been accomplished by the present invention wherein a generally square downwardly open enclosure, constructed and arranged to fit in a grid cell of a suspended ceiling, carries an elongate coaxial or biaxial fluorescent tube centrally located traversing two opposite sides of the enclosure. Included in the enclosure is a reflector disposed above the tube, with downwardly-facing reflective surfaces having a cross-sectional shape, taken perpendicular to the central axis of the tube, that is uniform along the axis and that is symmetrical on opposite sides of the axis. The reflector is a metal sheet held in place by self-spring-tension: a required illumination pattern in the 0° plane can be obtained by varying its curvature as determined by its length and/or through selection of different reflective surface properties.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
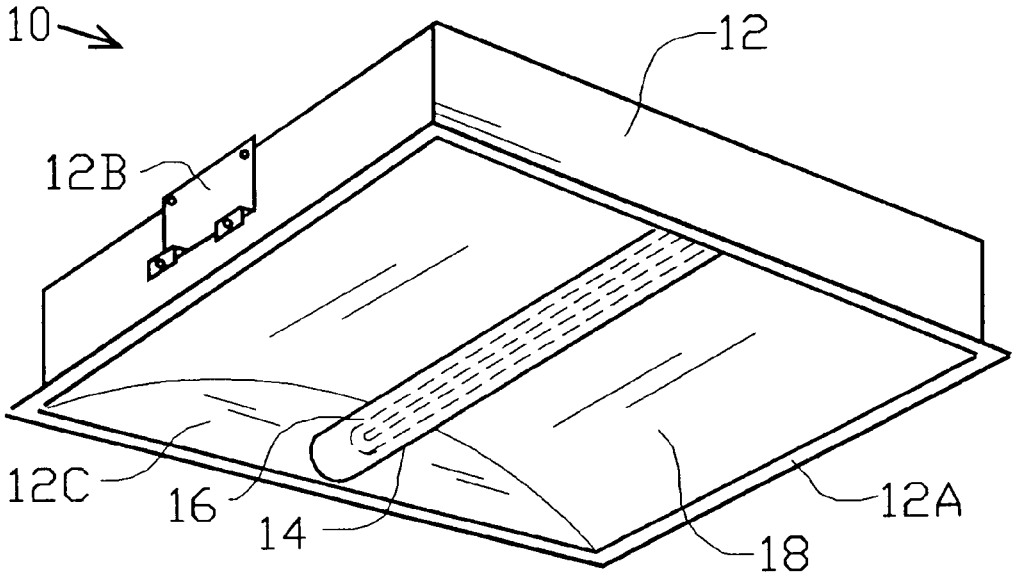
FIG. 1 is a perspective view of a fluorescent fixture of the present invention in an overhead location.

In FIG. 1 is a perspective view of a fluorescent fixture 10 of the present invention in an overhead location. Housing 12 is seen to have a peripheral trim strip 12A extending around the bottom edges; the edges of the trim strip form a square that is dimensioned to fit in place of a 2'×2' panel in a cell of subceiling supported by inverted T-bar rails and cross members. In such subceiling structure, all four sides of trim strip 12A will rest on the horizontally-extending bottom flange of the inverted T-bar grid, so that the fixture is supported in the same manner that a ceiling tile would normally be supported.

Fixture 10 is fitted with a U-shaped tube shield 14 that partially surrounds and conceals the fluorescent tube 16, in this example the location of a bi-coaxial type tube is indicated by dashed lines. Shield 14 extends across the housing 12 in a central location as shown. A curved sheet metal reflector 18 is disposed above tube 14, facing downwardly so as to reflect light from tube 14 downwardly into a room below. Tube 14 is supported and powered by a commercially available socket at the right hand end of the figure, not visible in this view. Alternatively an elongated single coaxial style tube could be utilized with a connector at each end. For purposes of built-in wall or ceiling installation, a mounting bracket 12B can be attached to each end of housing 12.

Figure 2:
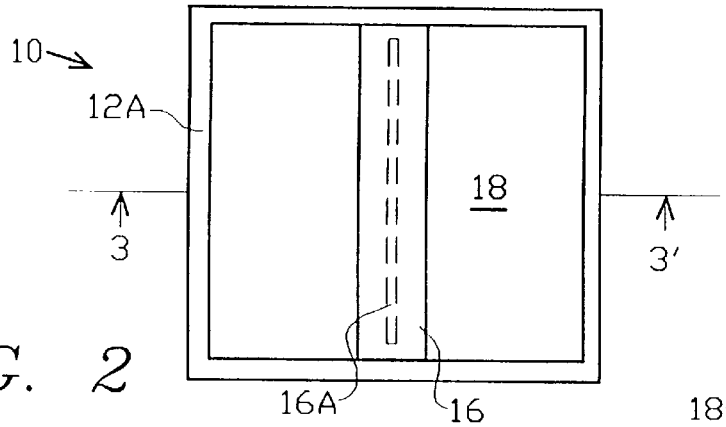
FIG. 2 is a bottom view of the fixture of FIG. 1, as viewed vertically from directly beneath.

FIG. 2 is a bottom view of the fixture 10 of FIG. 1, as it would appear looking vertically from directly beneath, showing peripheral trim strip 12, transverse light shield 16 and reflector 18.

An optional light slot 16A may be provided in shield 16 as indicated in dashed lines.

Figure 3:
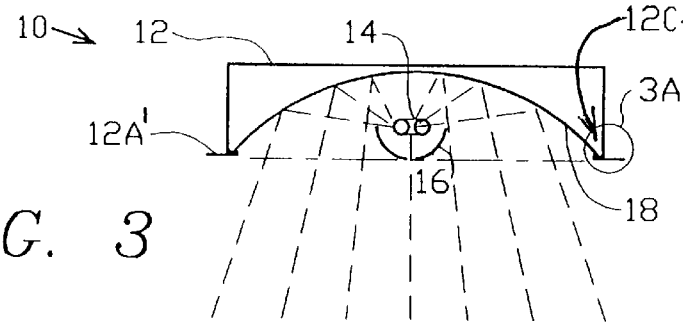
FIG. 3 is a cross-section taken through axis 3—3' of FIG. 1, in a plane perpendicular to the main axis of the fluorescent tube, showing the internal reflector and the shield channel, and indicating a pattern of reflected paths of light rays from the tube.

FIG. 3 is a cross-section of a single concave reflector embodiment of the invention taken through axis 3—3' of FIG. 1, in the 90° plane. Light shield 16, having a semi-circular U-shaped cross-section, shields room occupants from direct view of tube 14, with the exception of the narrow beam through optional slot 16A. Shield 16 may also be made to serve to a small extent as an upwardly directed reflector by making its inner surface reflective; i.e. white or mirrored. The relatively narrow beam illumination pattern from fixture 10 is indicated by typical light ray paths shown in the dashed lines; this pattern is seen to be symmetrical to each side of tube 14, with uniformity that can be controlled by shaping of the curvature of reflector 18.

The central vertical light path originates thru the optional slot 16A (FIG. 2), which can be made narrow enough to minimize glare or annoyance from almost all room locations.

Figure 3A:
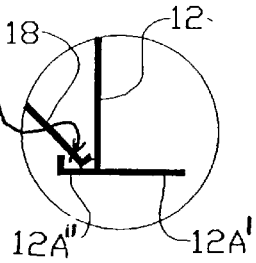
FIG. 3A is an enlarged cross-sectional detail showing edge retention of the reflector of the fixture of FIG. 2.

FIG. 3A is an enlarged cross-section taken at circle 3A of FIG. 3 at the right hand end of reflector 18 and lower right hand corner of housing 12, showing a trim strip 12A consisting of an outwardly extending flange 12A' and reflector-retaining channel 12C formed by a smaller flange 12A"; extending inwardly. Flange 12A' can be formed from the main sheet metal of housing 12 while the additional flange 12A for channel 12C can be spot-welded or otherwise fastened. The edge of reflector 18 is seen, formed with a small edge flange and retained in channel 12B. This method of retaining the ends of reflector 18 in channels 12B at the two opposite sides holds the reflector 18 in place in a self-stressed arched condition which presses reflector 18 against the top of housing 12 (refer to FIG. 3). The shape of the reflector's curvature depends strongly on the total length of the reflector 18, which can be made from a single sheet of metal or from two halves joined at the center by an overlapping joint which may be bonded together by double-sided adhesive or other means. The reflector 18 may be made from a sheet of high purity aluminum or other metal, and its reflecting surface can be a highly polished mirror surface, or it can be diffused, painted white or textured.

Figure 4:
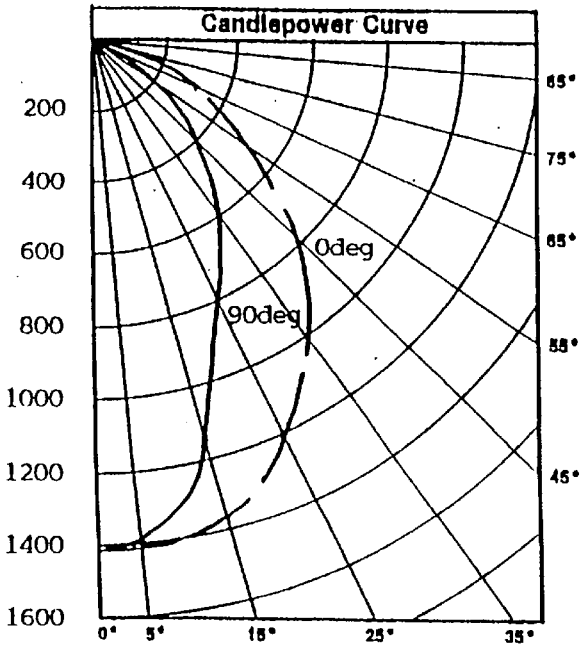
FIG. 4 is a polar graph of light output versus angle from vertical for the fixture of FIGS. 1–3.

FIG. 4 is a polar graph of a fixture configured with a single convex reflector as in FIG. 3, showing light intensity as a function of angle from vertical. It is seen that the solid line curve "90 deg", taken in the 90° plane, which is strongly influenced by the shape of reflector 18, falls to half power at about 28°, while the broken line curve "0 deg", taken in the 0° plane, falls to half power at 47°. While such a relatively narrow distribution pattern could be useful in special applications, for uniform coverage of a large area it would require excessively close spacing in the fixture array, especially in a low ceiling.

Figure 5:
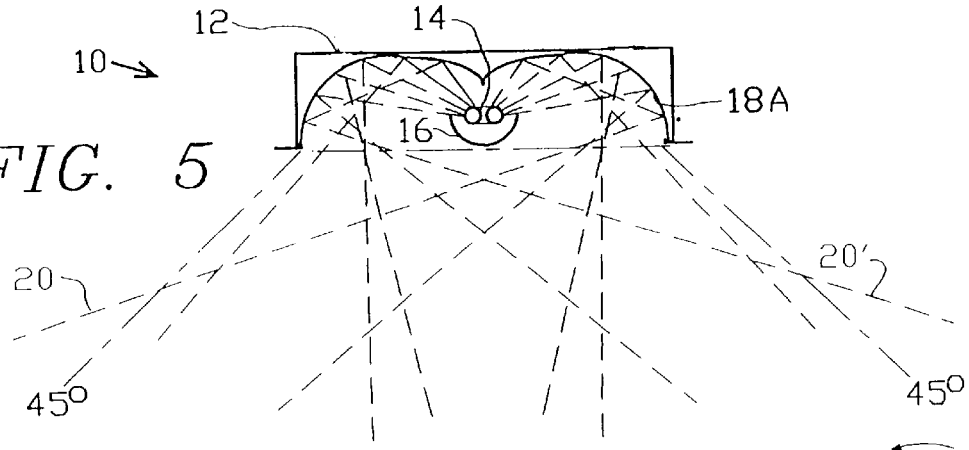
FIG. 5 is a cross-section of a light fixture as in FIG. 3, with the reflector configured in a dual concave shape, indicating a pattern of reflected paths of light rays from the tube including some undesirable high angle rays in the case of a smooth reflector surface.

FIG. 5 is a cross-sectional view of housing 12 fitted with a dual concave reflector 18A that can be made from two parts abutting at center as shown and joined there by double sided adhesive or other fastening means, forming a V-shaped downward central protrusion as shown. As before the reflector is retained in a stressed form with its ends between the channels at opposite sides of the housing 12 so that, as before, the curvature of the reflector can be determined by its dimension. In this instance the reflector is made relatively long to shape the reflector to a curvature of much smaller radius than in FIG. 3, for purposes of obtaining wider angle coverage. When shaped as shown and using a smooth mirror finish on reflector 12A, along with the wider coverage, there are double reflection paths that result in undesired high angle radiation paths 20 and 20', well above 45 degrees from vertical, that would cause objectionable glare and harshness and render this configuration unsuitable for the critical application of multiple large area coverage.

Figure 6:
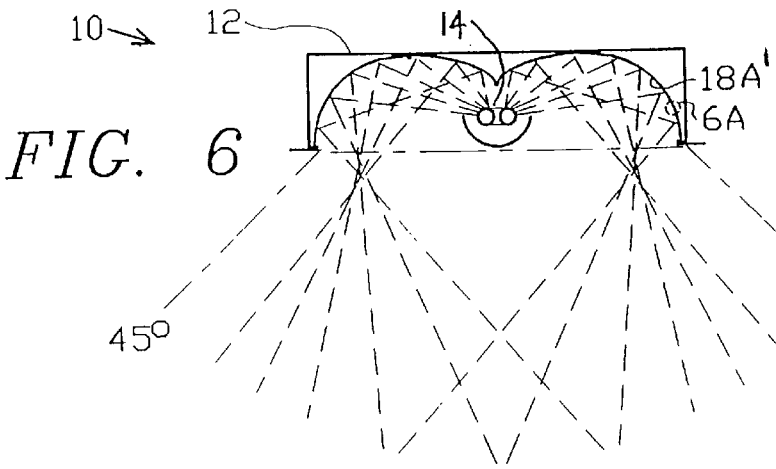
FIG. 6 is a cross-section of a light fixture having a reflector generally shaped as in FIG. 5, but made with a ridged surface that provides the indicated pattern of reflected paths of light rays from the tube, free of unwanted high angle rays.
Figure 6A:
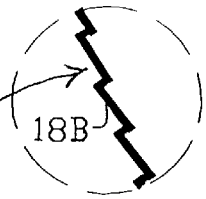
FIG. 6A is a highly enlarged cross-section of a portion of the reflector of FIG. 6, showing the detailed ramp pattern of the ridged surface.

FIG. 6 shows reflector 18A' having the same general shape as reflector 18A in FIG. 5, however it is made with a ridged surface shown in FIG. 6A, a highly enlarged portion 6A of reflector 18A' in FIG. 6. These small sawtooth-shaped ridges 18B, sized in the order of 0.02" step amplitude at 0.12" intervals, run parallel to the main axis of tube 14. The main facets are inclined about 10°, shift the direction of the reflected paths about 20°, thus shifting the high angle paths (that were problematic in FIG. 5) downwardly into the desired coverage region, less than 45 degrees from vertical and eliminating the glare problem discussed above in connection with FIG. 3.

Figure 7:
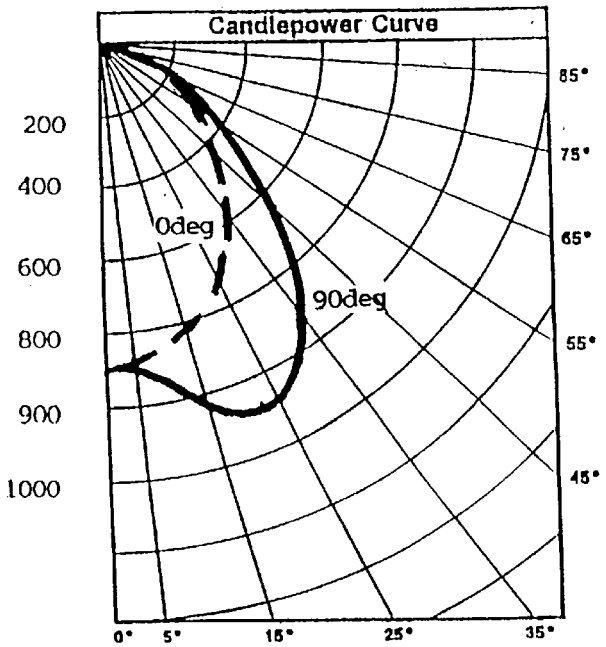
FIG. 7 is a polar graph of light output versus angle from vertical for the light fixture of FIG. 6.

FIG. 7 is a polar graph of a fixture configured with a dual convex reflector with a ridged surface as in FIG. 6, otherwise measured under the same conditions as the graph of FIG. 4. FIG. 6 indicates half power angles of 49° and 45°, so it is well suited to large area multiple coverage in low ceilings, and can be expected to be free of high angle glare.

The distribution pattern in the 0° plane (parallel to the tube) is relatively independent of reflector shape, as indicated by the similarity of the general shape and half power angle of the broken line curves in FIGS. 4 and 7. This 0° plane distribution pattern can be modified to a limited extent by the treatment of the surface of the exposed end regions of the interior of enclosure 12 at each end of the reflector 12/12A/12B: this can be mirrored, diffused, textured, ridged in a selected orientation or treated for anti-reflection.

In both of the embodiments measured in FIGS. 4 and 7 respectively the lamp used in the measurements was a single F55BX, 4800 lumens, running at 57 watts. The above described embodiments of the invention are rated to utilize a 40, 50 or 55 watt biaxial fluorescent lamp, however the invention can be practiced with lamps of other wattages, styles and technologies, such as incandescent, halogen and HID (high intensity discharge).

In a preferred embodiment of the invention, housing 12 is made square as shown above and dimensioned to fit in a 2'×2' subceiling grid cell, typically supported by an existing grid of inverted T-bar rails and cross-members. Alternatively the housing can be scaled to other dimensional requirements, and can be made in rectangular form, e.g. to fit a 2'×4' subceiling grid cell.

The invention can be practiced with the reflector configured in single or multiple curvature of various shapes, and its reflecting surface may be made mirror smooth, diffused or matte finish, textured, or ridged as described in connection with FIG. 6A, as required to achieve particular lighting objectives.

Housing 12 is typically made from 22 gauge cold rolled steel sheet, but could be made from other suitable metal or plastic materials.

In alternatives to the horizontally oriented ceiling location as described above, the fixture can be mounted in other orientations, e.g. vertical walls or sloping surfaces, and can be made to produce a variety of illumination patterns by modifications of the cross-sectional curvature shape and surface properties of the reflector.

The scope of the invention includes non-symmetrical lamp locations and reflector shapes as alternatives to the symmetrical configurations shown in the above described embodiments.

This invention may be embodied and practiced in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. An indirect fluorescent light fixture, for recessed deployment in ceilings and other flat architectural surfaces, optimized to provide maximal uniform glare-suppressed indirect illumination of a target area, comprising:

an enclosure, constructed with a top panel and four sidewalls thus defining a downwardly-facing light exit opening when deployed in a ceiling;

an elongate fluorescent lamp tube installed in an operative manner in said enclosure in a location such that a central axis of the lamp tube traverses a central region of said enclosure;

a primary reflector extending generally to extents of said enclosure and defining in cross-section, coaxial with said lamp tube, a pair of downwardly-facing concave reflecting surfaces flanking said lamp tube in a symmetrical manner, disposed above said lamp tube centrally, extending substantially to all four sides of said enclosure and having a cross-sectional shape, taken through the central axis of said lamp tube, that is uniform along the central axis and thus parallel to said lamp tube, the shape defining a downwardly-facing concave arc extending in a horizontally symmetrical manner above the lamp tube from a lower edge of a first side of the enclosure to a corresponding lower edge of a second side of enclosure opposite the first side, an elongated light control trough, constructed and arranged to serve as a combination glare shield and secondary reflector, disposed parallel with and substantially beneath said lamp tube in a lower portion of said enclosure; and a peripheral horizontal trim strip, defining a lower extremity of the sidewalls and bordering a substantially square downwardly-facing light exit opening, configured and arranged such that a major portion thereof extends outwardly from the sidewalls while a minor portion thereof extends inwardly from at least the first sidewall and the opposite second sidewall, the minor portion of said trim strip thus forming a retaining flange that cooperates with the corresponding sidewalls to retain said primary reflector in place by directing the spring tension thereof to act outwardly against the sidewalls;

said primary reflector being made from a flat sheet of metal and formed into the concave arc shape such as to be retained under spring tension, said primary reflector and said enclosure being dimensioned and arranged such that a top surface of said primary reflector is caused to be urged upwardly against a bottom surface of the top panel portion of said enclosure.

2. The indirect fluorescent light fixture as defined in claim 1 wherein said enclosure is configured and arranged to be generally square having a top panel portion of predetermined size dimension per side, with peripheral sidewalls extending from the top panel portion downwardly on all four sides to a predetermined depth dimension that is less than half of the size dimension.

3. The indirect fluorescent light fixture as defined in claim 1 wherein said elongated light control trough is made to have a cross-sectional shape, taken through the central axis of the lamp tube, that is uniform along the central axis, defining generally a semicircle concentric with the lamp tube so as to define a light shield having an upwardly-facing concave reflecting surface that substantially blocks further downward transmission of direct light rays from said lamp tube that would otherwise cause glare and instead redirects such light rays upwardly to said primary reflector, thence downwardly past said light control trough, thus maximizing useful indirect light output product of said fluorescent light fixture while minimizing unwanted glare.

4. The indirect fluorescent light fixture as defined in claim 1 wherein:

said enclosure is configured and arranged to be generally square having a top panel portion of predetermined size dimension per side, with peripheral sidewalls extending from the top panel portion downwardly on all four sides to a predetermined depth dimension that is less than half of the size dimension; and said lamp tube, said primary reflector and said light control trough are configured and relatively located so as to interact optically in a manner to yield a generally rectangular horizontal field of illumination such that said light fixture, when mounted in a recessed manner in a ceiling, provides a downwardly diverging light output directivity pattern that, at measured half-candlepower points, extends approximately 50 degrees from vertical along the central axis and approximately 30 degrees from vertical along an axis that is perpendicular to the central axis;

whereby an array of such light fixtures may be readily planned and implemented to provide quality low-glare indirect illumination of predetermined desired intensity, coverage and uniformity.

5. An indirect fluorescent light fixture, for recessed deployment in ceilings and other flat architectural surfaces, optimized to provide maximal uniform glare-suppressed indirect illumination of a target area, comprising:

an enclosure, constructed with a top panel and four sidewalls thus defining a downwardly-facing light exit opening when deployed in a ceiling;

an elongate fluorescent lamp tube installed in an operative manner in said enclosure in a location such that a central axis of the lamp tube traverses a central region of said enclosure;

a primary reflector extending substantially to all four sides of said enclosure and made to have a cross-sectional shape, taken through the central axis of said lamp tube, that is uniform along the central axis and thus parallel to said lamp tube, the shape defining a pair of side-by-side downwardly-facing half-sections shaped as concave arcs that are symmetrical about said lamp tube, extending inwardly in a horizontally symmetrical manner from respective opposite bottom edges of the enclosure to a high point where an top surface of each half-section concave arc touches a bottom surface of the top panel region, thence continuing in respective concave arc shapes to a central junction point defining a downward-pointing vertex located in a midregion between said lamp tube and the top panel region;

an elongated light control trough, constructed and arranged to serve as a combination glare shield and secondary reflector, disposed parallel with and substantially beneath said lamp tube in a lower portion of said enclosure; and a peripheral horizontal trim strip, defining a lower extremity of the sidewalls and bordering a substantially rectangular downwardly-facing light exit opening, configured and arranged such that a major portion thereof extends outwardly from the sidewalls while a minor portion thereof extends inwardly from at least the first sidewall and the opposite second sidewall, the minor portion of said trim strip thus forming a retaining flange that cooperates with the corresponding sidewalls to retain said primary reflector in place by directing the spring tension thereof to act outwardly against the sidewalls and upwardly against a bottom surface of the top panel of said enclosure.

6. The indirect fluorescent light fixture as defined in claim 5 wherein:

said primary reflector is configured with a pattern of ridges running parallel to said lamp tube, the ridges being shaped to have a sawtooth cross-sectional shape and oriented such as to further widen the wide-angle pattern of light output directivity in the axis that is perpendicular to the central axis.

7. The indirect fluorescent light fixture as defined in claim 6 wherein:

said lamp tube, said primary reflector and said light 10;

The indirect fluorescent light fixture as defined in claim 5 wherein:

said lamp tube, said primary reflector and said light control trough are configured and relatively located so as to interact optically in a manner to yield a generally square horizontal field of illumination such that said light fixture, when mounted in a recessed manner in a ceiling, provides a downwardly diverging light output directivity pattern that, at measured half-candlepower points, extends approximately 50 degrees from vertical along both the central axis and along the axis that is perpendicular to the central axis;

whereby an array of such light fixtures may be readily planned and implemented in a square-cell pattern in a ceiling to provide quality low-glare indirect illumination of predetermined desired intensity, coverage and uniformity.

8. The indirect fluorescent light fixture as defined in claim 5 wherein said elongated light control trough is made to have a cross-sectional shape, taken through the central axis of the lamp tube, that is uniform along the central axis, defining generally a semicircle concentric with the lamp tube so as to define a light shield having an upwardly-facing concave reflecting surface that substantially blocks further downward transmission of direct light rays from said lamp tube that would otherwise cause glare and instead redirects such light rays upwardly to said primary reflector, thence downwardly past said light control trough, thus maximizing useful indirect light output product of said fluorescent light fixture while minimizing unwanted glare.

9. The indirect fluorescent light fixture as defined in claim 5 wherein:

said enclosure is configured and arranged to be generally square having a top panel portion of predetermined size dimension per side, with peripheral sidewalls extending from the top panel portion downwardly on all four sides to a predetermined depth dimension that is less than half of the size dimension.

10. The indirect fluorescent light fixture as defined in claim 9 wherein:

said lamp tube, said primary reflector and said light control trough are configured and relatively located so as to interact optically in a manner to yield a generally rectangular horizontal field of illumination such that said light fixture, when mounted in a recessed manner in a ceiling, provides a downwardly diverging light output directivity pattern that, at measured half-candlepower points, extends approximately 50 degrees from vertical along the central axis and approximately 30 degrees from vertical along an axis that is perpendicular to the central axis;

whereby an array of such light fixtures may be readily planned and implemented to provide quality low-glare indirect illumination of predetermined desired intensity, coverage and uniformity.

* * * * *